US009795224B2

(12) United States Patent
George, II et al.

(10) Patent No.: US 9,795,224 B2
(45) Date of Patent: Oct. 24, 2017

(54) FRAMELESS FURNITURE ASSEMBLY

(71) Applicants: Daniel C. George, II, Grand Rapids, MI (US); Matthew Jung, Ada, MI (US)

(72) Inventors: Daniel C. George, II, Grand Rapids, MI (US); Matthew Jung, Ada, MI (US)

(73) Assignee: Comfort Research, LLC, Grand Rapids, MI (US)

( * ) Notice: Subject to any disclaimer, the term of this patent is extended or adjusted under 35 U.S.C. 154(b) by 0 days.

(21) Appl. No.: 15/220,200

(22) Filed: Jul. 26, 2016

(65) Prior Publication Data

US 2016/0331147 A1 Nov. 17, 2016

Related U.S. Application Data

(63) Continuation of application No. 14/516,064, filed on Oct. 16, 2014, now Pat. No. 9,398,813, which is a continuation-in-part of application No. 13/659,565, filed on Oct. 24, 2012, now abandoned.

(60) Provisional application No. 61/550,690, filed on Oct. 24, 2011.

(51) Int. Cl.

| | |
|---|---|
| ***A47C 5/00*** | (2006.01) |
| ***A47C 27/08*** | (2006.01) |
| ***A47C 7/62*** | (2006.01) |
| ***A47C 3/16*** | (2006.01) |
| ***A47C 4/00*** | (2006.01) |
| ***A47C 7/18*** | (2006.01) |
| ***A47C 7/54*** | (2006.01) |

(52) U.S. Cl.

CPC ..... *A47C 27/086* (2013.01); *A47C 3/16* (2013.01); *A47C 4/00* (2013.01); *A47C 7/18* (2013.01); *A47C 7/54* (2013.01); *A47C 7/62* (2013.01)

(58) Field of Classification Search

CPC ..... A47C 27/086; A47C 7/62; A47C 4/00; A47C 7/54; A47C 7/18; A47C 3/16

USPC ..... 297/188.01, 188.19, 452.17

See application file for complete search history.

(56) References Cited

U.S. PATENT DOCUMENTS

| | | | | |
|---|---|---|---|---|
| 3,830,270 A * | 8/1974 | Hagert | B65D 81/3876 | 224/148.5 |
| 3,899,210 A * | 8/1975 | Samhammer | A47C 1/02 | 297/448.2 |
| 3,965,506 A * | 6/1976 | Marks | A47C 3/16 | 297/452.17 |
| 4,011,611 A * | 3/1977 | Lederman | A47C 3/16 | 273/DIG. 2 |
| 4,027,888 A * | 6/1977 | Wilcox | A47C 27/086 | 297/284.1 |
| D262,676 S * | 1/1982 | Roset | D6/334 | |

(Continued)

FOREIGN PATENT DOCUMENTS

GB 2059758 A * 4/1981 ..... A47C 3/16

*Primary Examiner* — Rodney B White

(74) *Attorney, Agent, or Firm* — King & Partners, PLC

(57) ABSTRACT

A frameless furniture assembly adapted to be converted between an unfilled configuration and a filled configuration including: an outer liner having an inner surface and an outer surface; a plurality of pieces of fill material, wherein the fill material is retained withi n the outer liner; and a container holder associated with the outer liner. The frameless furniture assembly is preferably adapted to support a human in a seated position.

4 Claims, 6 Drawing Sheets

(56) References Cited

U.S. PATENT DOCUMENTS 4,449,654 A * 5/1984 Cappis ..... A45F 3/16 224/148.3
D287,551 S * 1/1987 Lewis ..... D6/334
5,735,573 A * 4/1998 Vredevoogd ..... A47C 1/0242 297/188.01
5,890,809 A * 4/1999 Nelson ..... A45C 3/00 224/148.5
6,045,178 A * 4/2000 Miller ..... A47C 3/16 297/129
6,141,807 A * 11/2000 Tapper ..... A47C 3/16 5/640
6,209,962 B1 * 4/2001 Sobel ..... A47C 3/16 297/452.17
6,279,184 B1 * 8/2001 George, II ..... A47C 27/086 297/462
6,295,650 B1 * 10/2001 Baacke ..... A41D 13/0012 2/462
6,334,227 B1 * 1/2002 Larger ..... A47C 3/16 5/653
6,422,439 B1 * 7/2002 Kelliher ..... A45F 3/16 190/110
6,732,391 B2 * 5/2004 George, II ..... A47C 27/086 5/652
6,824,209 B1 * 11/2004 Redzisz ..... A47C 4/283 297/183.5
6,952,906 B2 * 10/2005 Nelson ..... A47C 27/086 53/432
7,886,949 B2 * 2/2011 Fenton ..... A45C 7/0063 224/645
7,896,207 B1 * 3/2011 Latham ..... A45F 4/02 224/416
7,938,302 B2 * 5/2011 Gibson ..... A45F 3/04 224/660
D650,576 S * 12/2011 Bertken ..... D3/217
8,070,225 B2 * 12/2011 Machabee ..... B60N 2/26 297/188.01
8,123,093 B2 * 2/2012 Merzon ..... A45C 11/00 224/250
8,336,964 B2 * 12/2012 Cho ..... A47C 3/16 297/452.17
8,465,090 B1 * 6/2013 O'Connor ..... A47C 7/62 297/184.16
2005/0072644 A1 * 4/2005 Gormick ..... A45C 3/02 190/111
2007/0095872 A1 * 5/2007 White ..... B62J 9/00 224/420
2012/0112502 A1 * 5/2012 Cristoforo ..... A47C 31/11 297/188.01

* cited by examiner

FRAMELESS FURNITURE ASSEMBLY

CROSS-REFERENCE TO RELATED APPLICATIONS

This application is a continuation of U.S. patent application Ser. No. 14/516,064, Oct. 16, 2014, entitled "Frameless Furniture Assembly," now U.S. Pat. No. 9,398,813, which is a continuation-in-part of U.S. patent application Ser. No. 13/659,565, filed Oct. 24, 2012, entitled "Frameless Furniture Having a Container Holder," which claims the benefit of U.S. Provisional Patent Application Ser. No. 61/550,690, filed Oct. 24, 2011, entitled "Frameless Furniture Having a Container Holder," which are hereby incorporated herein by reference in their entirety, including all references cited therein.

BACKGROUND OF THE INVENTION

1. Field of the Invention

The present invention relates in general to frameless furniture (e.g., bean bags, video loungers, etcetera) and, more particularly, to a frameless furniture assembly that comprises one or more container holders.

2. Background Art

Frameless chairs have been known in the art for years and are the subject of a plurality of patents and publications, including: U.S. Pat. No. 6,725,482 entitled "Frameless Chair," U.S. Pat. No. 6,279,184 entitled "Frameless Chair," and United States Patent Application Publication Number 2003/0066268 entitled "Process for Packaging a Polyurethane Foam Filled Article of Furniture"—all of which are hereby incorporated herein by reference in their entirety including the references cited therein.

U.S. Pat. Nos. 6,725,482 and 6,279,184 appear to disclose a substantially spherical frameless chair comprising an at least partially gas permeable outer liner, an at least partially gas permeable inner liner positioned inside of the outer liner, and a plurality of polyurethane foam pieces having a density between approximately 1.0 and approximately 3.0 pounds per cubic foot retained within the inner liner. The outer liner includes a first end component having a substantially circular peripheral geometry, a second end component having a substantially circular peripheral geometry, and an intermediate component having a substantially rectangular peripheral geometry wherein the first and second end components are secured to the intermediate component to, in turn, form a substantially spherical outer liner. The inner liner includes a first end component having a substantially circular peripheral geometry, a second end component having a substantially circular peripheral geometry, and an intermediate component having a substantially rectangular peripheral geometry, wherein the first and second end components are secured to the intermediate component to, in turn, form a substantially spherical inner liner.

United States Patent Application Publication Number 2003/0066268 appears to disclose a process for packaging a polyurethane foam filled article of furniture (e.g., a frameless chair), comprising the steps of: (a) providing a polyurethane foam filled article of furniture having an initial volume; (b) reducing the initial volume of the polyurethane foam filled article of furniture to a reduced volume, comprising at least one of the steps of: (1) decreasing air pressure within the polyurethane foam filled article of furniture via a vacuum source; and (2) compressing the initial volume of the polyurethane foam filled article of furniture to a reduced volume; and (c) associating the polyurethane foam filled article of furniture with a package.

Moreover, a plurality of apparatuses associated with container holders have been known in the art for years and are the subject of a plurality of patents and publications, including: U.S. Pat. No. 7,735,931 entitled "Portable Chair Apparatus," U.S. Pat. No. 7,571,965 entitled "Molded Foam Pool Chair," U.S. Pat. No. 7,273,251 entitled "Video Game Chair," U.S. Pat. No. 6,997,509 entitled "Juvenile Seat Cup Holder," U.S. Pat. No. 5,213,394 entitled "Molded Recliner Rocker Chair," U.S. Pat. No. 5,004,296 entitled "Floating Lounge Chair," U.S. Pat. No. 4,964,600 entitled "Insulated Cup Holder With Flexible Base Member," U.S. Pat. No. 4,662,852 entitled "Floating, Reclining Lounge Mechanism," U.S. Pat. No. 4,564,240 entitled "Lounger or Reclining Chair Made From a Floatable Plastic Body," United States Patent Application Publication Number 2007/0257530 entitled "Video Game Chair," and United States Patent Application Publication Number 2005/0242643 entitled "Ergonomic Rocker"—all of which are hereby incorporated herein by reference in their entirety including the references cited therein.

U.S. Pat. No. 7,735,931 appears to disclose a portable chair apparatus which includes a hollow, collapsible chair and a receptacle attached to the chair for containing the chair when it is in collapsed condition. An electrically operated air pump is used to alternatively inflate or deflate the chair.

U.S. Pat. No. 7,571,965 appears to disclose a molded foam pool chair that is a continuous form of pliable foam material of constant density having varying thicknesses to provide a rigid base portion and an elastic seat portion. The rigid base portion extends around and is continuous with the elastic seat portion. The rigid base portion defines a peripheral edge having a shape and has cross-sectional areas of sufficient thickness and width to prevent substantial distortion of the shape of the peripheral edge between unloaded and loaded conditions. The elastic seat portion has an upper surface, a lower surface and a thickness for receiving a substantial portion of the weight of a person and extending downward within water into a loaded position, such that the upper surface of the elastic seat portion when in the loaded position, is disposed substantially beneath an unloaded seat position defined by the lower surface when disposed in an unloaded position.

U.S. Pat. No. 7,273,251 appears to disclose a video game chair for enhancing the enjoyment of a video game which includes a chair member formed of a horizontal seat portion with a backrest portion vertically extending therefrom. Adjacent each of two opposing sides of the seat portion is an adjustable arm with a game controller mounted thereon. A speaker and adjustable leg are mounted adjacent each of two opposing sides of the backrest portion. An interface box is removably attached to a lower surface of the seat portion for electrically connecting the speakers and controller to a conventional game box.

U.S. Pat. No. 6,997,509 appears to disclose a juvenile seat including a base and a cup holder. The cup holder is pivotably coupled to the base to move between a closed position adjacent the base and an opened position extending from the base.

U.S. Pat. No. 5,213,394 appears to disclose a molded reclining rocker chair having a continuous body support panel with a head torso supporting portion smoothly joined to a rump and thigh supporting panel portion which, in turn, is smoothly connected to a leg and foot supporting panel portion. A pair of depending side rocker panels begin at the outermost tip of the head and torso panel portion and extend along the sides of the panel portions to smoothly and curvingly diverge from the outermost tip to proximate the beginning of the rump and thigh portion to form a concave side panel and a further shallow convexly curved portion leading to the tip of the leg and foot supporting panel portions. A runner is integrally molded to the lower edge of each side panel and a brace member extends between the side panels at the rump supporting portion of the thigh portion. The runner portion is thickened in the area of the concave rocker side panel to modify the radius of curvature thereof and strengthen the rocker runner at the point of most radial loading, pressure and wear. In addition, it makes it easier to shift from reclining to sitting position and vice versa. Snap fasteners or VELCRO fasteners for pads and pillows are provided and a swiveled or gimbaled cup holder is utilized on the panel side. Hand-holds are also provided. Slotted panels allow air flow through head and torso and leg and foot panels. The construction is preferably made out of fiberglass because it is more resistant to cracking.

U.S. Pat. No. 5,004,296 appears to disclose a floating lounge chair that can also be used on land. A relatively light weight rigid panel acts as a base for an elongated air cushion, such that the person can be fully supported in a reclining position on the cushion. A U-shaped rigid plastic foam arm rest is attached to the rigid panel. Various recesses are formed in the plastic foam material to hold various items (e.g., a beverage glass, portable radio, book, etcetera).

U.S. Pat. No. 4,964,600 appears to disclose a bag-like, flexible base member having flowable, granular particles therein secured to the bottom of a rigid frame member having insulated interior walls to provide an insulated cup holder that may be placed on uneven surfaces without spilling a portable contained in a cup held by the novel holder. The frame may be coextensive with or extend above the insulation that lines the interior of the frame. In the embodiment where the frame extends beyond the insulation, a screw-threaded, rim-mounted member enhances the integrity of the structure. In another embodiment, the holder is surrounded by the bag-like base member.

U.S. Pat. No. 4,662,852 appears to disclose a floating, reclining lounge including a mechanism to permit it to be easily adjusted in the aquatic environment without the need for manually applied lifting force. In one embodiment, the mechanism includes a slotted bracket with resilient sockets which enable the seat of the lounge to be moved and secured in select positions of adjustment. In another embodiment, the mechanism includes a slotted bracket having a rack and pinion to facilitate such adjustment.

U.S. Pat. No. 4,564,240 appears to disclose a lounger or reclining chair made from a rigid plastic body with a continuous supporting surface. The lounger or reclining chair is floatable and at the same time possesses the qualities of erectable loungers or reclining chairs, so that the user can float on the water in a comfortable and restful position on the water with the lounger or reclining chair. For this purpose, the floating body has been designed to be floatable and is provided with at least one cavity which is enclosed on all sides, in order to produce the buoyancy. The top surface of the plastic body, which acts as a supporting surface, has a depression which is adapted to the shape of a human body.

United States Patent Application Publication Number 2007/0257530 appears to disclose a video game chair that comprises a game console interface for receiving a vibration feedback signal from a game console; lighting; and a lighting controller for controlling the lighting based on the vibration feedback signal. The game console interface may be capable of connecting wirelessly with the game console. The vibration feedback signal may represent an intensity of vibration. The lighting may include at least one set of LEDs positioned under the video game chair for generating ground lighting. The lighting controller may flicker the lights at an intensity based on the vibration feedback signal. The lighting may include at least two sets of colored lights, and the lighting controller may control lighting of the sets of lights based on the vibration feedback signal. Each set of colored lights may be a different color. The lighting controller may flicker the lights when the vibration feedback signal exceeds a threshold.

United States Patent Application Publication Number 2005/0242643 appears to disclose an ergonomic rocking chair that maximizes circulation and relaxation while minimizing spinal pressure and other physical discomforts. The ergonomic rocking chair facilitates quick and easy assembly and disassembly, and may be selectively stabilized and/or adapted to perform ancillary functions.

While the above-identified patents and publications do appear to disclose frameless furniture assemblies, as well as container holders, their configurations remain non-desirous and/or problematic inasmuch as, among other things, none of the above-identified frameless furniture assemblies appear to be configured to beneficially, simply and effectively enable a user to retain a container and/or beverage within a holder as is disclosed herein—among other things.

It is therefore an object of the present invention to provide a frameless furniture assembly that comprises one or more container holders.

These and other objects of the present invention will become apparent in light of the present specification, claims, and drawings.

SUMMARY OF THE INVENTION

The present invention is directed to, in one embodiment, a frameless furniture assembly adapted to be converted between an unfilled configuration and a filled configuration, comprising: (a) an outer liner having an inner surface and an outer surface; (b) a plurality of pieces of fill material, wherein the fill material is retained within the outer liner; and (c) a container holder associated with the outer liner.

In a preferred embodiment of the present invention, the frameless furniture assembly comprises a chair adapted to support a human in a seated position.

In another preferred embodiment of the present invention, the frameless chair comprises at least one of a seat member, a back support member, a left arm, a right arm, a floor-engaging base member, a left side, a right side, a front side, a back side, and a zipper.

In yet another preferred embodiment of the present invention, at least a portion of the floor-engaging base member is generally air permeable and the remainder of the frameless chair is generally air impermeable.

In another aspect of the present invention, the outer liner comprises thirteen rectangular swatches and two generally L-shaped swatches.

In a preferred embodiment of the present invention, the plurality of pieces of fill material comprise polystyrene.

In another preferred embodiment of the present invention, at least one of the left and right sides comprise an accessory pocket.

In yet another preferred embodiment of the present invention, the frameless furniture assembly comprises a container holder. In this embodiment the container holder preferably comprises a left flap member having an outer surface, an inner surface, and at least one elastic loop, a right flap member having an outer surface, an inner surface, and at least one elastic loop, a bottom flap member having an outer surface, an inner surface, and at least one elastic loop, and an elastic band threaded through each elastic loop of the left flap member, the right flap member, and the bottom flap member.

In another aspect of the present invention, the outer surface of the bottom flap member preferably contacts the inner surface of both the left flap member and the right flap member when the container holder is void of a container.

The present invention is also directed to, in one embodiment, a frameless furniture assembly adapted to be converted between an unfilled configuration and a filled configuration, comprising: (a) an outer liner having an inner surface and an outer surface, and wherein the outer liner comprises thirteen rectangular swatches and two generally L-shaped swatches; (b) a plurality of pieces of fill material, wherein the plurality of pieces of fill material are retained within the outer liner, and wherein the plurality of pieces of fill material comprise polystyrene; (c) wherein the frameless furniture assembly comprises a seat member, a back support member, a left arm, a right arm, a floor-engaging base member, a left side, a right side, a front side, and a back side; (d) wherein at least a portion of the floor-engaging base member is generally air permeable and the remainder of the frameless chair is generally air impermeable, and wherein the floor-engaging base member comprises a zipper; (e) wherein at least one of the left and right sides comprise an accessory pocket; (f) wherein at least one of the left and right sides comprise a container holder and wherein the container holder comprises a left flap member having an outer surface, an inner surface, and at least one elastic loop, a right flap member having an outer surface, an inner surface, and at least one elastic loop, a bottom flap member having an outer surface, an inner surface, and at least one elastic loop, and an elastic band threaded through each elastic loop of the left flap member, the right flap member, and the bottom flap member, and wherein the outer surface of the bottom flap member contacts the inner surface of both the left flap member and the right flap member when the container holder is void of a container; and (g) wherein the frameless furniture assembly comprises a chair adapted to support a human in a seated position.

The present invention is further directed to, in one embodiment, a frameless furniture assembly adapted to be converted between an unfilled configuration and a filled configuration, comprising: (a) an outer liner having an inner surface and an outer surface; (b) a plurality of pieces of fill material, wherein the fill material is retained within the outer liner; (c) a container holder associated with the outer liner; (d) a container holder, wherein the container holder comprises a left flap member having an outer surface, an inner surface, and at least one elastic loop, a right flap member having an outer surface, an inner surface, and at least one elastic loop, a bottom flap member having an outer surface, an inner surface, and at least one elastic loop, and an elastic band threaded through each elastic loop of the left flap member the right flap member, and the bottom flap member; and (e) wherein the frameless furniture assembly comprises a chair adapted to support a human in a seated position.

BRIEF DESCRIPTION OF THE DRAWINGS

The invention will now be described with reference to the drawings wherein.

DETAILED DESCRIPTION OF THE INVENTION

Figure 1:
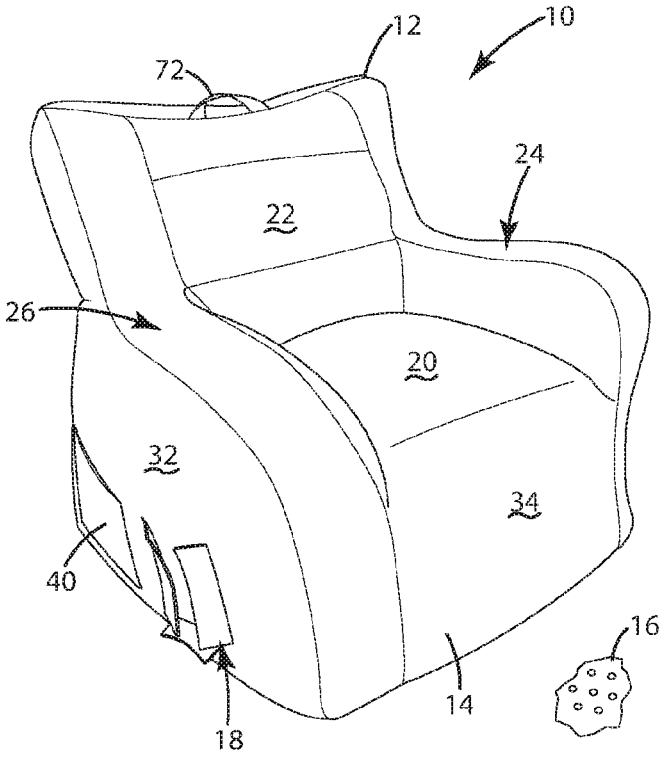
FIG. 1 of the drawings is an isometric view illustrating the front right portion of a frameless furniture assembly in accordance with the present invention.
Figure 2:
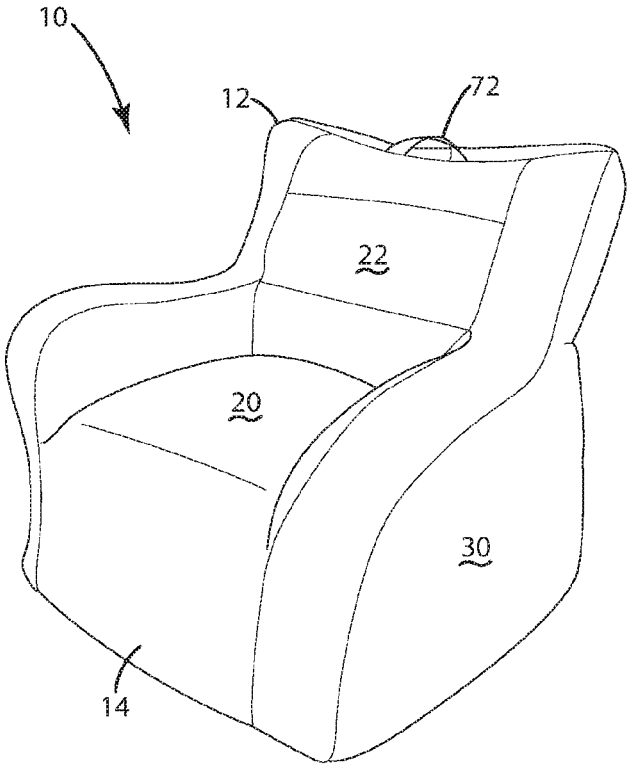
FIG. 2 of the drawings is an isometric view illustrating the front left portion of a frameless furniture assembly in accordance with the present invention.
Figure 3:
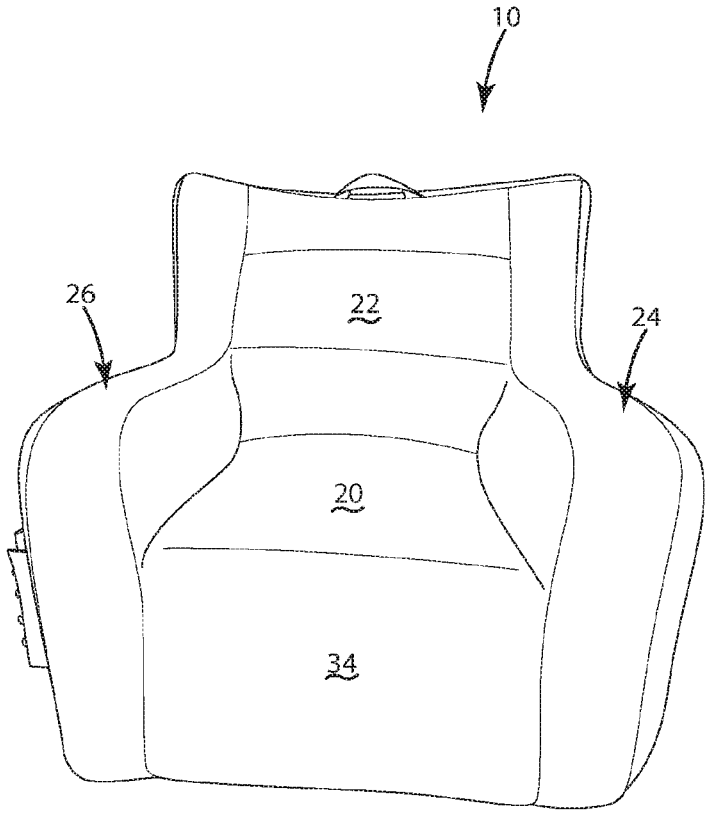
FIG. 3 of the drawings is a front view of a frameless furniture assembly in accordance with the present invention.
Figure 4:
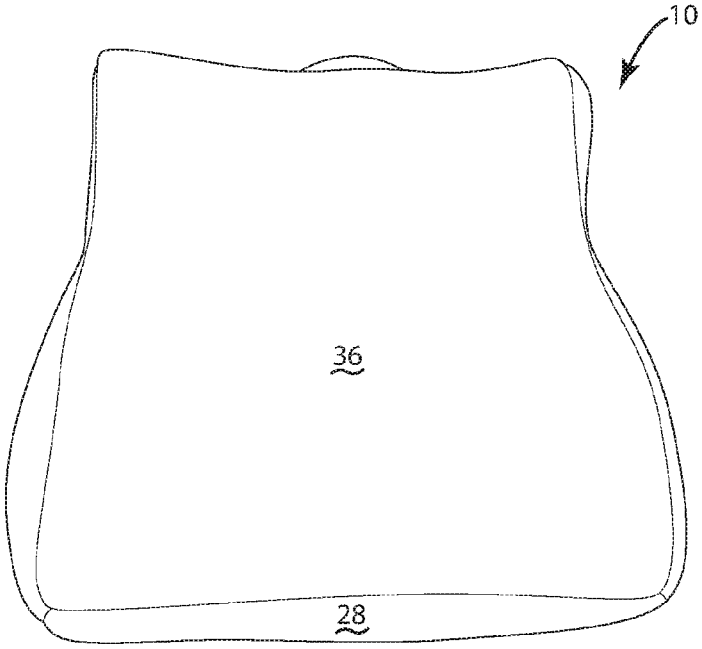
FIG. 4 of the drawings is a back view of a frameless furniture assembly in accordance with the present invention.
Figure 5:
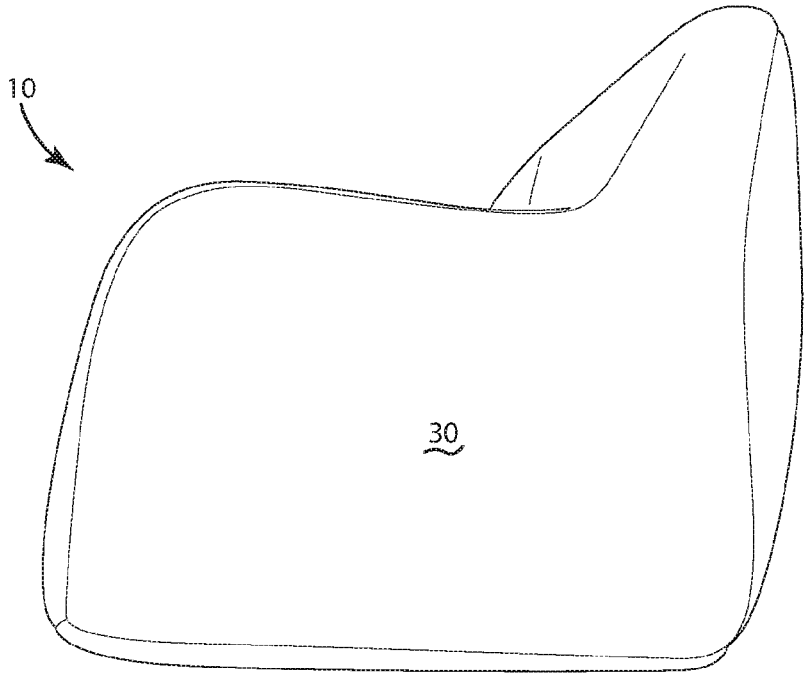
FIG. 5 of the drawings is a left side elevation of a frameless furniture assembly in accordance with the present invention.

While this invention is susceptible of embodiment in many different forms, there is shown in the drawings and will be described herein in detail, one or more specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIG. 1 in particular, frameless furniture assembly 10 (e.g., a chair adapted to support a human in a seated position) is shown which generally comprises outer liner 12 having an inner surface (not shown) and an outer surface 14, a plurality of fill material 16 (e.g., polyurethane, polyester, polystyrene, hybrids of the same, etcetera) retained within outer liner 12, and container holder 18.

In one embodiment of the present invention, and as is best shown collectively in FIGS. 1-8, when frameless furniture assembly 10 is generally filled with fill material 16, frameless furniture assembly 10 generally comprises seat member 20, back support member 22, left arm 24, right arm 26, floor-engaging base member 28, left side 30, right side 32, front side 34, and back side 36. It will be understood that one or more of the above-identified sub-components may be omitted from frameless furniture assembly 10 so long as it remains adapted to support a human in a seated position.

Figure 8:
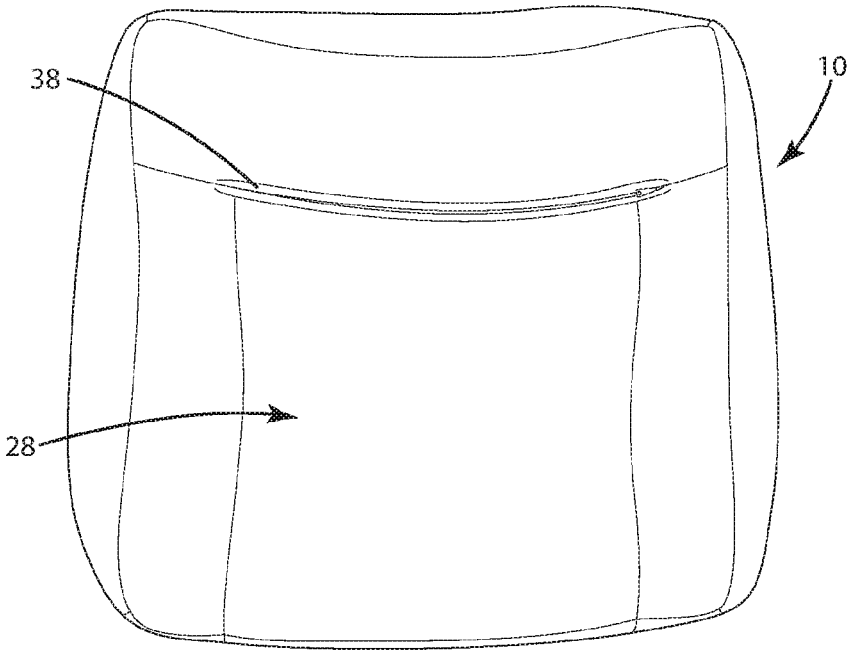
FIG. 8 of the drawings is a bottom view of a frameless furniture assembly in accordance with the present invention.
Figure 9:
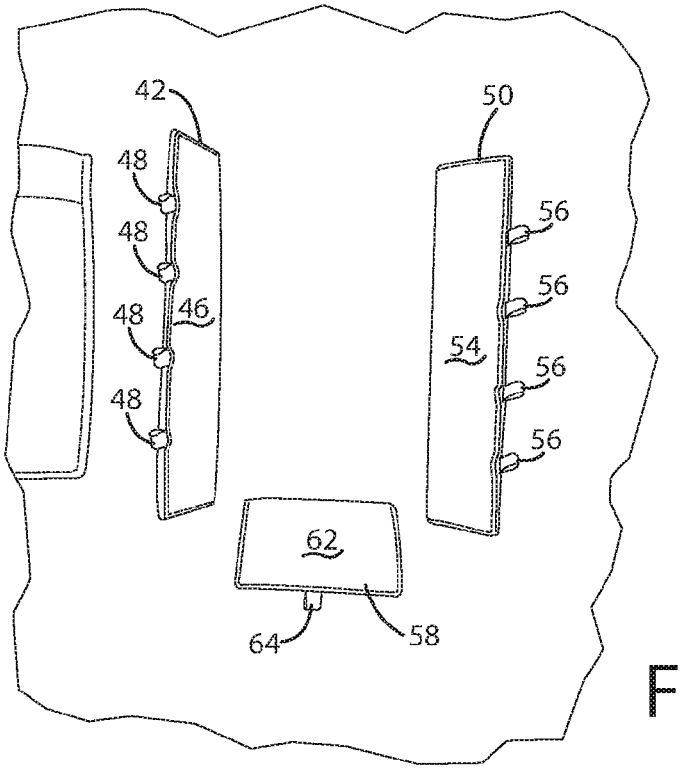
FIG. 9 of the drawings is a fragmented right side view of a frameless furniture assembly in accordance with the present invention illustrating a container holder in an open and unlaced configuration.
Figure 10:
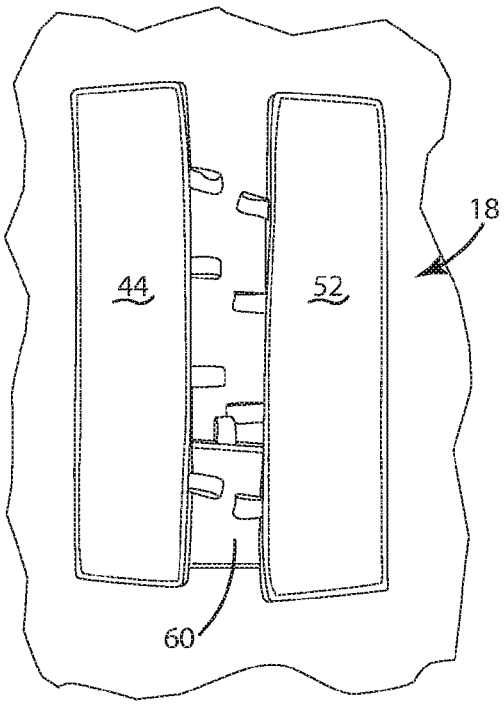
FIG. 10 of the drawings is a fragmented right side view of a frameless furniture assembly in accordance with the present invention illustrating a container holder in a closed and unlaced configuration.

As is best shown in FIG. 8, at least a portion of floor-engaging base member 28 is generally air and/or moisture permeable. Such air permeability facilitates rapid filling of frameless furniture assembly 10 during free-flow and/or pressurized fills. Additionally, the moisture permeability allows frameless furniture assembly 10 to reduce and/or eliminate undesirable growth of, for example, bacteria, spores, mold, mildew, etcetera. In one embodiment, the remainder of frameless furniture assembly 10 is generally air and/or moisture impermeable.

Referring once again to FIG. 8, floor-engaging base member 28 includes zipper 38. Zipper 38 may include a single or double zipper.

In a preferred embodiment of the present invention, the plurality of pieces of fill material 16 comprise polystyrene. However, it will be understood that the fill material may also comprise polyurethane, natural and/or synthetic materials, and/or fibers.

Figure 6:
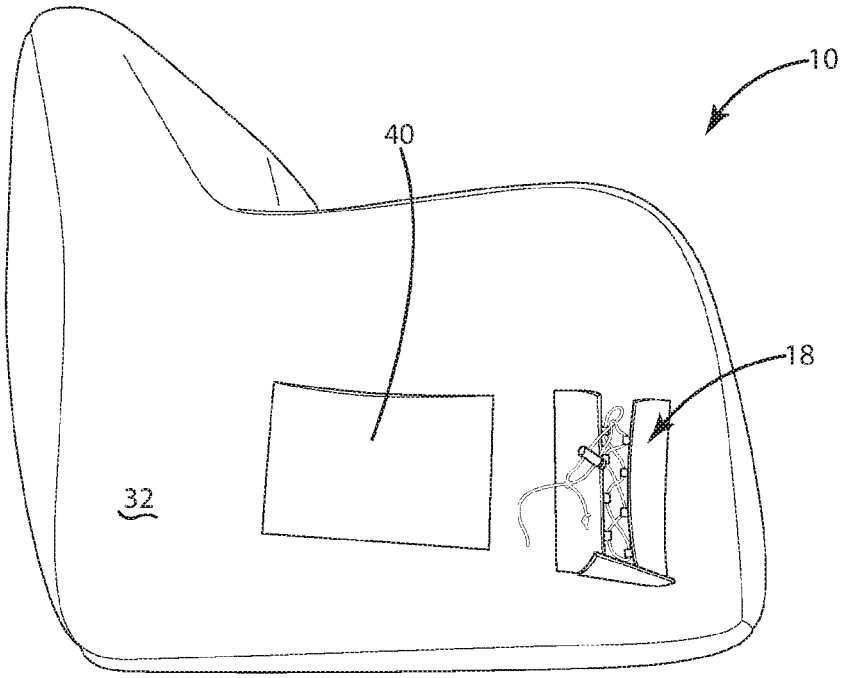
FIG. 6 of the drawings is a right side elevation of a frameless furniture assembly in accordance with the present invention.
Figure 7:
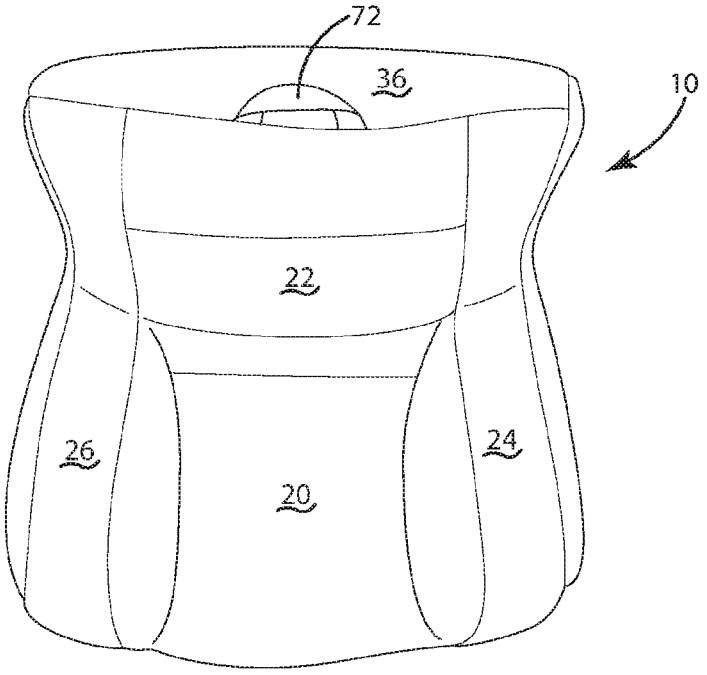
FIG. 7 of the drawings is a top view of a frameless furniture assembly in accordance with the present invention.
Figure 11:
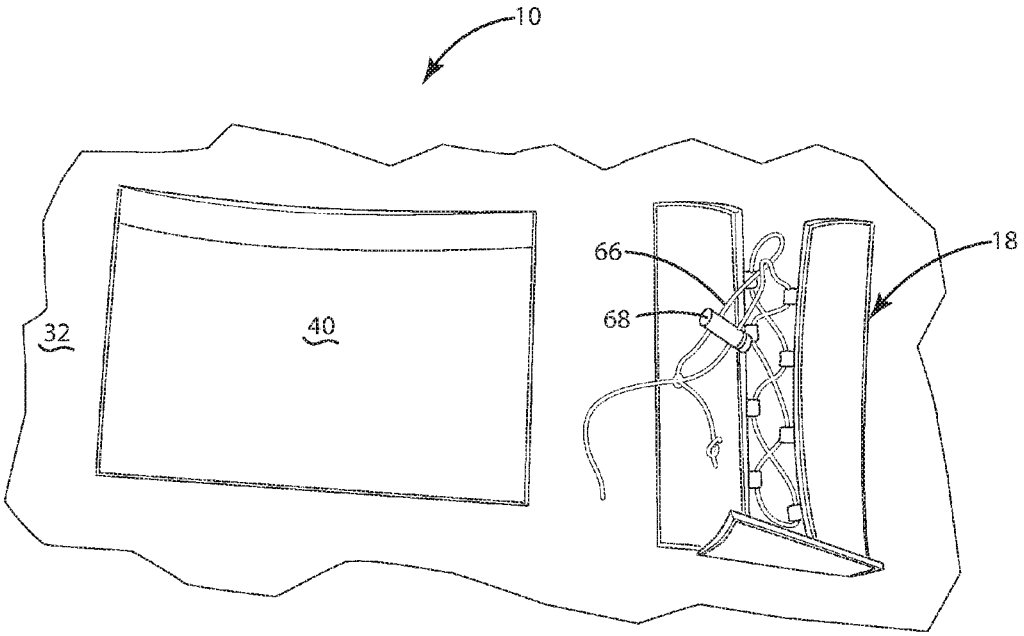
FIG. 11 of the drawings is a fragmented right side view of a frameless furniture assembly in accordance with the present invention illustrating a container holder in a closed and laced configuration adjacent to an accessory pocket.

Referring now to FIGS. 1, 6, and 11, frameless furniture assembly 10 preferably includes accessory pocket 40. Accessory pocket 40 is adapted to retain, for example, a remote control, earphones, headphones, as well as other electronic and non-electronic accessories.

Referring now to FIGS. 1, 6, and 9-12, frameless furniture assembly 10 includes container holder 18 (e.g., a bottle or cup holder). Preferably container holder 18 is associated with at least one of left side 30 and right side 32. In a preferred embodiment of the present invention, container holder 18 comprises: (a) left flap member 42 having outer surface 44, inner surface 46, and elastic loops 48; (b) right flap member 50 having outer surface 52, inner surface 54, and elastic loops 56; (c) bottom flap member 58 having outer surface 60, inner surface 62, and elastic loop 64; and (d) elastic band 66 threaded through each elastic loop 48, 56, and 64 of left flap member 42, right flap member 50, and bottom flap member 58, respectively. In this embodiment, elastic band 66 is preferably enclosed and/or securely looped via a knot and/or releasable fastener 68.

Referring now to FIG. 11, in one embodiment of the present invention, outer surface 60 of bottom flap member 58 contacts inner surfaces 46 and 54 of left flap member 42 and right flap member 50, respectively, when container holder 18 is void of a container.

Figure 12:
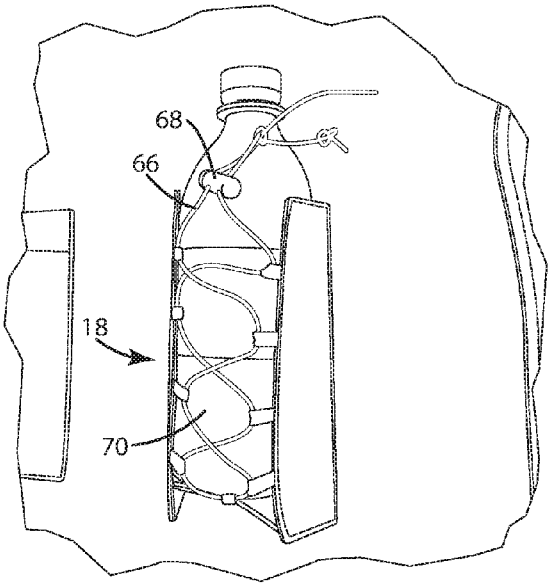
FIG. 12 of the drawings is a fragmented right side view of a frameless furniture assembly in accordance with the present invention illustrating a container holder in a closed and laced configuration securing a water bottle therein.

As is best shown in FIG. 12, container holder 18 conveniently and releasably secures container 70 so that a user may retain and/or hold any one of a number of container shapes and sizes.

Frameless furniture assembly 10 may also include an optional inner liner as is disclosed in U.S. Pat. No. 6,725,482 entitled "Frameless Chair," and U.S. Pat. No. 6,279,184 entitled "Frameless Chair."

Referring now to FIG. 1, in one embodiment of the present invention, frameless furniture assembly 10 includes handle 72 which is preferably positioned proximate the top portion of back support member 22.

Referring once again to FIGS. 1-8 and as is highlighted via transparent representation in FIG. 1, outer liner 12 preferably comprises thirteen rectangular swatches and two generally L-shaped swatches which are fastened together proximate their peripheral geometries. Preferably, the swatches of outer liner 12 are stitched together via single-needle lock stitch and/or double-needle top stitch.

In a preferred embodiment of the present invention, the outer liner and the optional inner liner may comprise breathable or non-breathable fabrics such as cotton, denim, wool, and/or any one of a number of synthetic fabrics—just to name a few.

The foregoing description merely explains and illustrates the invention and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A frameless furniture assembly adapted to be converted between an unfilled configuration and a filled configuration, comprising:

an outer liner having an inner surface and an outer surface;

a plurality of pieces of fill material, wherein the fill material is retained within the outer liner;

a container holder associated with the outer liner, wherein the container holder comprises a left flap member having an outer surface, an inner surface, and at least one elastic loop, a right flap member having an outer surface, an inner surface, and at least one elastic loop, a bottom flap member having an outer surface, an inner surface, and at least one elastic loop positioned on a top surface of the bottom flap member, and an elastic band threaded through each elastic loop of the left flap member, the right flap member, and the bottom flap member;

wherein the outer surface of the bottom flap member contacts the inner surface of both the left flap member and the right flap member when the container holder is void of a container; and wherein the frameless furniture assembly comprises a chair adapted to support a human in a seated position; and wherein the chair comprises a seat member, a back support member, a left arm, a right arm, a floor-engaging base member, a left side, a right side, a front side, and a back side.

2. The frameless furniture assembly according to claim 1, wherein the floor-engaging base member comprises a zipper.

3. The frameless furniture assembly according to claim 2, wherein the plurality of pieces of fill material comprise polystyrene.

4. The frameless furniture assembly according to claim 3, wherein at least one of the left and right sides comprise an accessory pocket.

* * * * *